US009714537B2

(12) United States Patent
Maher

(10) Patent No.: US 9,714,537 B2
(45) Date of Patent: Jul. 25, 2017

(54) DOOR COMMUNICATION DEVICE

(71) Applicant: Basic Design Solutions, Inc., Fowler, IL (US)

(72) Inventor: Jay A. Maher, Lake Barrington, IL (US)

(73) Assignee: Basic Design Solutions, Inc., Fowler, IL (US)

( * ) Notice: Subject to any disclaimer, the term of this patent is extended or adjusted under 35 U.S.C. 154(b) by 0 days.

(21) Appl. No.: 14/805,689

(22) Filed: Jul. 22, 2015

(65) Prior Publication Data

US 2016/0076300 A1 Mar. 17, 2016

Related U.S. Application Data

(60) Provisional application No. 62/049,125, filed on Sep. 11, 2014.

(51) Int. Cl.

| | |
|---|---|
| ***E06B 7/30*** | (2006.01) |
| ***E06B 5/16*** | (2006.01) |
| *G09F 11/06* | (2006.01) |
| *G09F 23/00* | (2006.01) |

(52) U.S. Cl.

CPC ..... *E06B 7/30* (2013.01); *E06B 5/164* (2013.01); *G09F 11/06* (2013.01); *G09F 23/00* (2013.01)

(58) Field of Classification Search

CPC . E06B 7/30; E06B 5/164; G02B 25/04; G09F 11/04

USPC ..... 49/169, 171

See application file for complete search history.

(56) References Cited

U.S. PATENT DOCUMENTS

| | | | | | |
|---|---|---|---|---|---|
| 2,169,874 | A * | 8/1939 | Hardt | E06B 7/30 | 359/504 |
| 2,304,995 | A * | 12/1942 | Frankel | E06B 7/30 | 292/300 |
| 4,251,127 | A * | 2/1981 | Yamaguchi | E06B 7/30 | 359/504 |
| 4,269,474 | A * | 5/1981 | Kamimura | G02B 25/04 | 359/504 |
| 4,348,083 | A * | 9/1982 | Kamimura | G02B 25/04 | 359/504 |
| 4,763,444 | A * | 8/1988 | Ritchie | E06B 7/30 | 359/511 |
| 4,854,061 | A * | 8/1989 | Khoshkish | G09F 11/04 | 116/204 |
| 4,881,335 | A * | 11/1989 | Khoshkish | G09F 11/04 | 116/204 |
| 5,221,992 | A * | 6/1993 | Park | G02B 25/04 | 359/504 |
| 7,552,554 | B1 | 6/2009 | Marquardt et al. | | |

* cited by examiner

*Primary Examiner* — Justin Rephann

(74) *Attorney, Agent, or Firm* — Polster, Lieder, Woodruff & Lucchesi, LC

(57) ABSTRACT

A door communication device for use with a door. The door communication device includes a rotatable message wheel for selectively displaying a selected one of a plurality of messages and a rotatable shaft that provides an optical viewing pathway through the door. The shaft is formed from an intumescent material that expands to block the bore of the shaft when sufficiently heated, such as by a fire, to inhibit the passage of heated air and smoke through the door.

25 Claims, 6 Drawing Sheets

DOOR COMMUNICATION DEVICE

BACKGROUND

The present disclosure is directed to a door communication device for use with a door that provides an optical viewing pathway through the door and that provides for the communication of written messages from a first side of the door to a second side of the door, and in particular to a door communication device having a shaft with a bore through which the optical viewing pathway extends and wherein the shaft is formed from an intumescent material that expands when heated above a predetermined temperature to block the bore of the shaft and thereby increase the fire resistance rating of the door.

BRIEF DESCRIPTION OF THE DRAWING FIGURES

DETAILED DESCRIPTION

Figure 1:
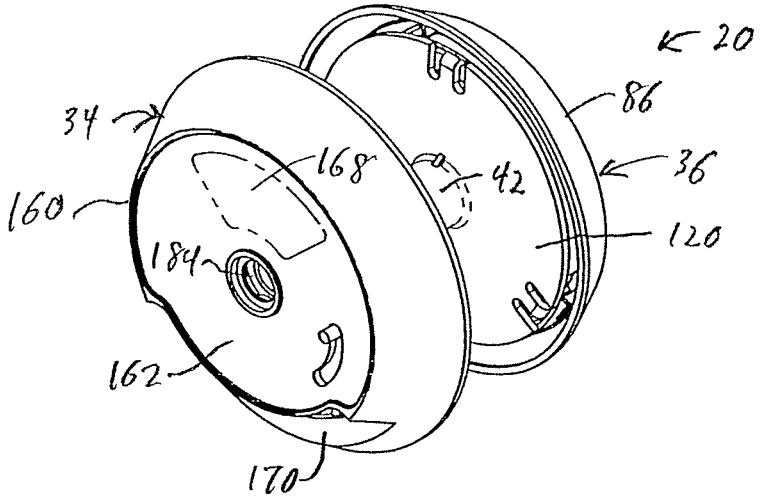
FIG. 1 is a perspective view of a door communication device of the present disclosure.
Figure 2:
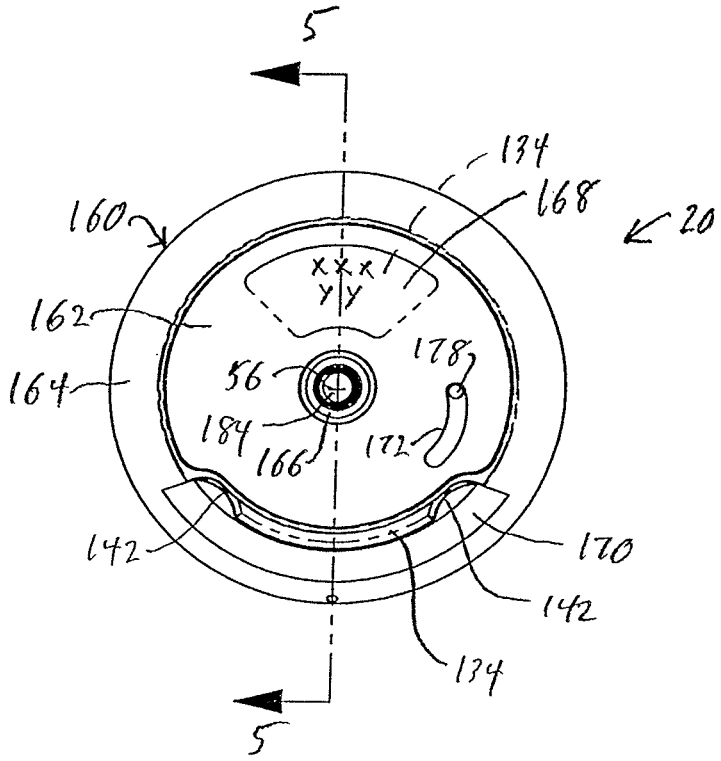
FIG. 2 is a front elevational view of the door communication device showing the interior unit.
Figure 3:
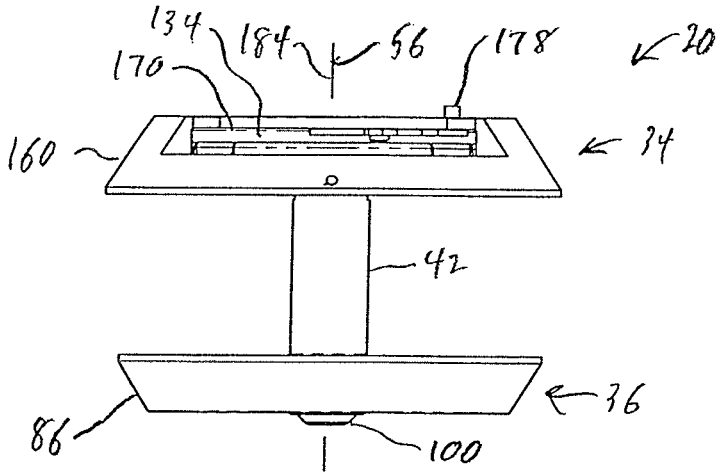
FIG. 3 is a bottom view of the door communication device showing the interior unit coupled to the exterior unit.
Figure 4:
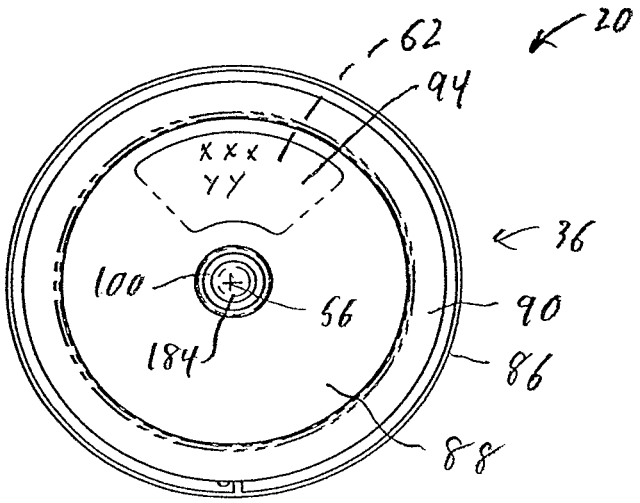
FIG. 4 is a rear view elevational of the door communication device showing the exterior unit.

The present disclosure relates to a door communication device adapted to be mounted to a door for providing an optical viewing pathway through the door and for selecting a visual written message from the inside of the door for display on the outside of the door, while providing a selected increased fire rating for the door. An embodiment of the door communication device is shown in the drawing figures as door communication device 20. Door communication device

20 is adapted to be mounted or coupled to a door 22. Door 22 includes a generally planar inside surface 24 and a generally planar outside surface 26 that is generally parallel to and spaced apart from inside surface 24. Door 22 includes a core 28 between inside surface 24 and outside surface 26. Door 22 may be made from wood, metal, plastic or other materials. Core 28 may be solid or hollow. A generally cylindrical bore 30 extends through door 22 from inside surface 24 to outside surface 26 and through core 28.

Door 22 may be a standard-type door as typically used to provide or deny access to a room by opening or closing of the door. Door 22 may be used in connection with a room such as a hotel room, office, and other types of rooms or spaces. When door 22 is in a closed position, inside surface 24 is located on the inside of door 22 and outside surface 26 is located on the outside of door 22. The inside of door 22 is typically located within the room to which door 22 is controlling access. The outside of door 22 may be located adjacent another room, a hallway, a common area, or other space.

Figure 5:
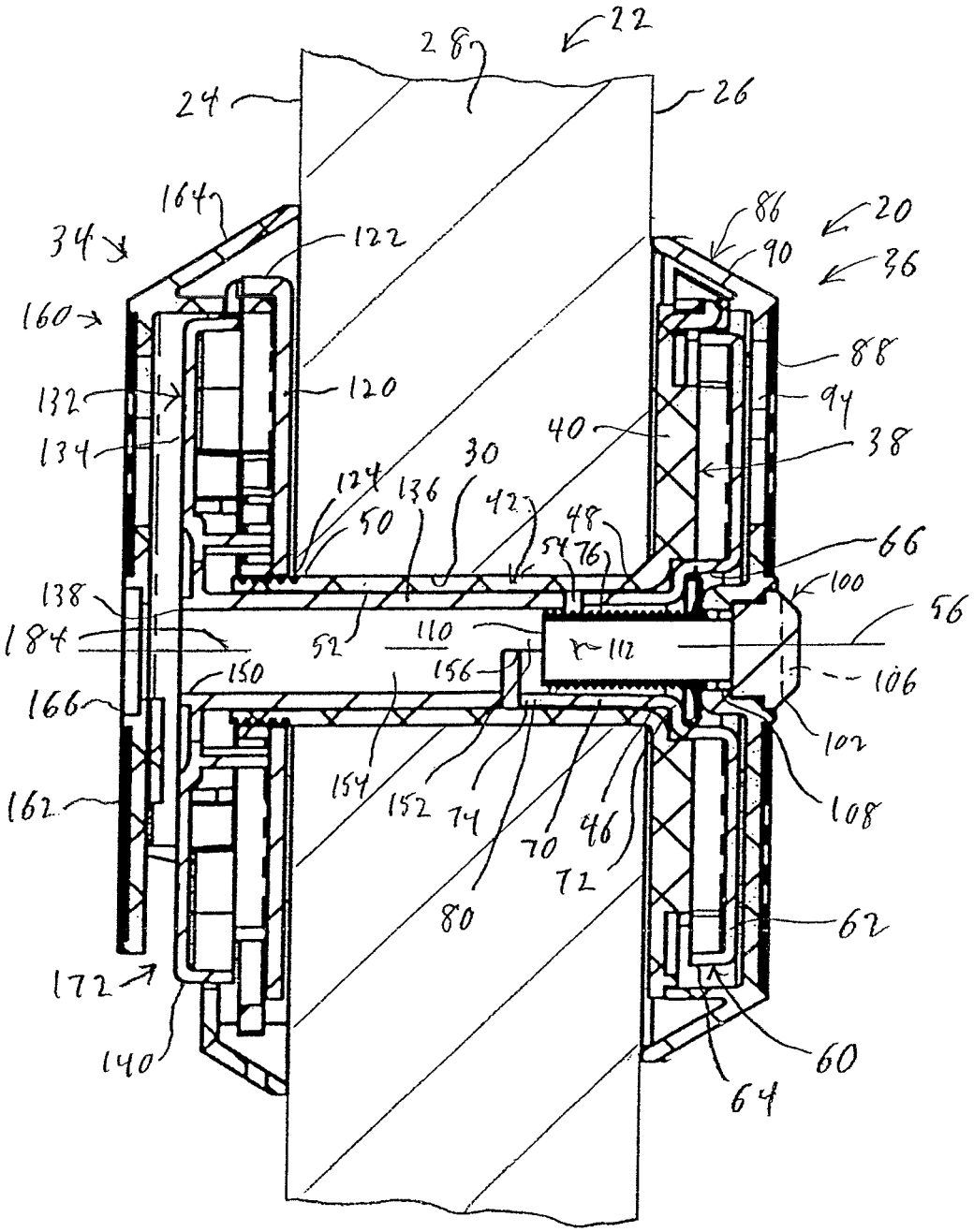
FIG. 5 is a cross sectional view taken along line 5-5 of FIG. 2 showing the door communication device coupled to a door with the interior unit adjacent the inside surface of the door and the exterior unit adjacent the outside surface of the door and with the optical viewing pathway of the door communication device extending through the door.

Door communication device 20 includes an interior unit 34 and an exterior unit 36. Interior unit 34 is adapted to be located adjacent inside surface 24 of door 22 and exterior unit 36 is adapted to be located adjacent outside surface 26 of door 22. Exterior unit 36 includes an exterior mounting member 38 including an exterior stationary plate 40 and a coupler member 42. Exterior stationary plate 40 is generally disc-like and includes a generally circular peripheral edge 44 and a generally circular central aperture 46. Coupler member 42 comprises a generally cylindrical tube and extends from a first end 48 to a second end 50 and includes a generally cylindrical interior surface forming a hollow bore 54. First end 48 of coupler member 42 is coupled to an interior surface of exterior stationary plate 40 such that bore 54 is aligned with and in communication with aperture 46. Second end 50 of coupler member 42 may be externally threaded. Coupler member 42 and bore 54 extend between first end 48 and second end 50 generally concentrically about a linear central axis 56 as shown in FIG. 5. The interior surface of exterior stationary plate 40 is located adjacent outside surface 26 of door 22 with coupler member 42 extending into and through bore 30 of door 22 such that second end 50 of coupler member 42 projects outwardly from inside surface 24 of door 22. An exterior surface of coupler member 42 fits closely against core 28 of door 22 along the length of bore 30.

Exterior unit 36 also includes an exterior message wheel 60. Exterior message wheel 60 includes an exterior message plate 62 having a generally circular peripheral edge 64 and a generally circular central aperture 66. Exterior message plate 62 includes a generally planar exterior surface 68. Exterior message plate 62 is located adjacent an exterior surface of exterior stationary plate 40 with central axis 56 extending centrally through central aperture 66. Exterior message wheel 60 also includes a generally cylindrical and tubular shaft 70 having a first end 72 and a second end 74. Shaft 70 includes a hollow generally cylindrical bore 76 that extends from first end 72 to second end 74. First end 72 of shaft 70 is coupled to exterior message plate 62 such that shaft 70 is generally perpendicular thereto and such that bore 76 is in alignment with and in communication with central aperture 66. Shaft 70 extends from exterior message plate 62 and into bore 54 of coupler member 42 such that second end 74 of shaft 70 is located within bore 54 of coupler member 42 and such that shaft 70 is in rotatable engagement with coupler member 42. Central axis 56 extends concentrically through bore 76 of shaft 70. Exterior message wheel 60, including exterior message plate 62 and shaft 70, are adapted to be selectively conjointly rotatable about central axis 56 with respect to exterior stationary plate 40 and door 22. Second end 74 of shaft 70 may include a tab 80 formed by a section of the wall of shaft 70 that extends approximately 180 degrees about central axis 56.

A plurality of written indicia, such as written messages, including text and/or symbols, may be located on exterior surface 68 of exterior message plate 62 and spaced apart from one another about central axis 56. Alternatively, a label 78 including the plurality of written messages may be coupled to exterior surface 68 of exterior message plate 62. The written messages may be, for example, "Do Not Disturb", "Please Service Room", "Late Check Out". "Housekeeping in Room", "Meeting In Progress", "Please Enter", "Please Knock" and the like.

Exterior unit 36 includes an exterior cover 86 having a generally planar exterior wall 88 and a side wall 90 that extends around a generally circular edge of exterior wall 88 forming a chamber. Exterior wall 88 includes a central aperture 92 concentrically aligned with central axis 56 and a window 94 located radially outwardly from central aperture 92 and central axis 56. Window 94 may be formed as an opening or as a clear member formed from a clear material such as plastic or glass. A selected one of the plurality of written messages on exterior message plate 62 is adapted to be viewed through window 94 of exterior cover 86. A distal end of side wall 90 is adapted to be located adjacent outside surface 26 of door 22 with exterior message plate 62 and exterior stationary plate 40 located within the chamber of exterior cover 86. Exterior cover 86 may be removably coupled to exterior stationary plate 40 with a snap-fit connection, fasteners or the like.

Exterior unit 36 also includes an optical viewer 100 having a head 102 and a generally cylindrical and tubular shaft 104. Head 102 includes a bore. Head 102 may include a lens 106 located in the bore that may comprise a clear material such as glass or plastic. Shaft 104 includes a first end 108 coupled to head 102 and a second end 110. A hollow generally cylindrical bore 112 extends through shaft 104 and head 102 and is located concentrically about central axis 56. Lens 106 is concentrically aligned with central axis 56 and in optical communication with bore 112. Optical viewer 100 is coupled to exterior cover 86. Head 102 is located within central aperture 92 of exterior cover 86 and shaft 104 of optical viewer 100 extends concentrically within shaft 70 of exterior message wheel 60. If desired, shaft 104 of optical viewer 100 may be externally threaded. Shaft 70 of exterior message wheel 60 is in rotatable engagement with shaft 104 of optical viewer 100 such that shaft 70 and exterior message plate 62 of exterior message wheel 60 are conjointly rotatable with respect to shaft 104 of optical viewer 100 about central axis 56. A fastener 114, such as a push nut, engages shaft 104 and couples optical viewer 100 to exterior cover 86.

Interior unit 34 of door communication device 20 includes an interior mounting member such as interior stationary plate 120. Interior stationary plate 120 includes a generally circular peripheral edge 122 and a central aperture 124 that is generally circular, but that may include opposing and generally parallel linear edge portions. Interior stationary plate 120 is adapted to be located adjacent inside surface 24 of door 22 such that second end 50 of coupler member 42 extends through central aperture 124. Second end 50 of coupler member 42 may include two planar flat surfaces that are generally parallel to one another and that are adapted to respectively engage the linear edge portions of central aperture 124 of interior stationary plate 120 and coupler member 42 to prevent rotation with respect to one another about central axis 56. A fastener 126, such as a threaded nut, is threadably attached to second end 50 of coupler member 42 to thereby couple interior stationary plate 120 and exterior mounting member 38 to door 22. An interior surface of interior stationary plate 120 may include one or more rotational indexing members 128 located radially outwardly from central aperture 124 and uniformly spaced from one another about central aperture 124. Each indexing member 128 may comprise, for example, a magnet, detent, protuberance or the like.

Interior unit 34 also includes an interior message wheel 132 having an interior message plate 134 and a generally cylindrical and tubular shaft 136. Internal message plate 134 includes a generally circular central aperture 138 located concentrically about central axis 56 and a generally circular peripheral edge 140. Peripheral edge 140 includes a plurality of concavely curved notches 142 spaced uniformly apart from one another about central axis 56. An interior surface of interior message plate 134 includes one or more rotational indexing members 144. Each indexing member 144 may comprise, for example, a magnet, detent, protuberance or the like.

Interior message plate 134 includes a generally planar exterior surface that may include a plurality of written indicia, such as written messages, that may comprise text and/or images. Alternatively, a label 146 including the written messages may be applied to the exterior surface of interior message plate 134. The written messages on interior message plate 134 correspond to the same written messages on exterior message plate 62 of exterior message wheel 60. The written messages on interior message plate 134 are located radially outwardly from aperture 138 and are uniformly spaced apart from one another about aperture 138.

Figure 12:
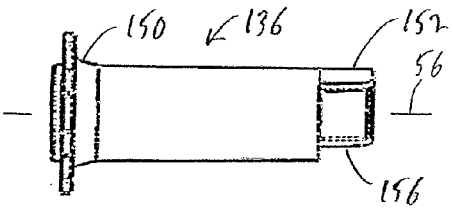
FIG. 12 is a side elevational view of the shaft of the interior message wheel.
Figure 13:
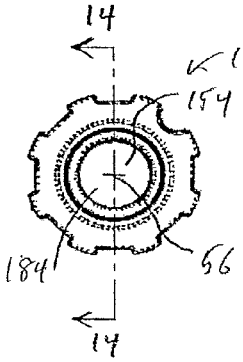
FIG. 13 is an end view of the shaft of the interior message wheel.
Figure 14:
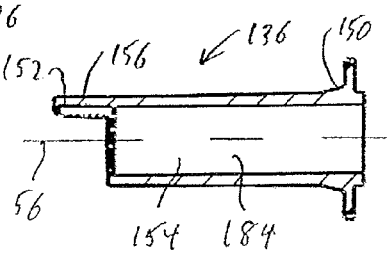
FIG. 14 is a cross-sectional view of the shaft of the interior message wheel taken along line 14-14 of FIG. 13.

Shaft 136 of interior message wheel 132 includes a first end 150 coupled to internal message plate 134 and a second end 152. Shaft 136 includes a generally cylindrical hollow bore 154 having a generally cylindrical internal surface that extends from first end 150 to second end 152. Shaft 136 and base 154 extend concentrically about and along central axis 56. Aperture 138 of interior message wheel 132 is aligned with and in optical communication with bore 154. Second end 152 of shaft 136 includes a tab 156 that comprises a portion of the wall of shaft 136 and that extends approximately 180 degrees about central axis 56. Shaft 136 may initially be formed or molded as shown in FIGS. 12-14 and then placed in a mold for molding of interior message plate 134 to first end 150 of shaft 136.

Shaft 136 of interior message wheel 132 is inserted into bore 54 of coupler member 42 at second end 50 of coupler member 42 such that interior message plate 134 is located adjacent to and overlies interior stationary plate 120. Shaft 136 extends through central aperture 124 of interior stationary plate 120 and into bore 54 of coupler member 42 such that tab 156 of shaft 136 of interior message wheel 132 is adapted to rotatably engage tab 80 of shaft 70 of exterior message wheel 60, such that interior message wheel 132 and exterior message wheel 60 are rotationally coupled to one another for conjoint rotation about central axis 56. Exterior surface of shaft 136 is adapted to rotationally engage the interior surface of coupler member 42. As shown in FIG. 5, second end 152 of shaft 136 is located adjacent second end 110 of shaft 104 of optical viewer 100. Second end 152 of shaft 136 is located more closely to outside surface 26 of door 22 than inside surface 24, such that shaft 136 extends more than halfway through the thickness of door 22 between inside surface 24 and outside surface 26.

Interior unit 34 also includes an interior cover 60 adapted to be removably coupled to interior stationary plate 120. Interior cover 160 includes a generally planar central wall 162 and a side wall 164 coupled to and that extends around central wall 162. Central wall 162 includes a generally circular central aperture 166 concentrically aligned with central axis 56 and in optical communication with bore 154 of shaft 136 of interior message wheel 132. If desired, central aperture 166 may include a clear lens, made from a clear material such as plastic or glass. Central wall 162 also includes a window 168 through which a selected one of the plurality of messages on interior message plate 134 may be viewed. Window 168 may comprise an opening or may include a clear member formed from a clear material such as plastic or glass.

Interior cover 160 also includes a curved slot 170 that extends through the edges of central wall 162 and side wall 164. Slot 170 is adapted to provide manual access therethrough by an individual user to peripheral edge 140 of interior message plate 134 such that the user may manually and selectively rotate interior message plate 134 and exterior message plate 62 conjointly therewith about central axis 56 to display a selected one of the plurality of written messages on interior message plate 134 and exterior message plate 62, the same written message being concurrently displayed on both the interior message plate 134 through window 168 and exterior message plate 62 through window 94. A user may thereby select any one of the written messages for display through windows 94 and 168 and may selectively change the written message being displayed as desired.

Central wall 162 of interior cover 160 also includes a curved slot 172 that is located between central aperture 166 and a peripheral edge of central wall 162. A shutter 176 is pivotally coupled to an internal surface of central wall 162 of interior cover 160 and is located within the chamber of interior cover 160. Shutter 176 includes a peg 178 that extends through slot 172 in central wall 162 to a distal end located outwardly from central wall 162. Shutter 176 is adapted to be selectively pivotally moveable between a closed position and an open position by selective movement of peg 178 within slot 172.

Door communication device 20 includes an optical viewing pathway 184 that extends through door communication device 20 and door 22 generally coaxially with central axis 56. Optical viewing pathway 184 extends through central aperture 166 of interior cover 160, aperture 138 of interior message plate 134, bore 154 of shaft 136, bore 112 of shaft 104 of optical viewer 100 and bore 76 of shaft 70, and through the bore and lens 106 of optical viewer 100. A user located inside of door 22 may thereby visually look through central aperture 166 of interior cover 160 and view along optical viewing pathway 184 to the outside of door 22, for example, to identify an individual located on the opposite side of door 22. When shutter 176 is in the closed position, shutter 176 blocks optical viewing pathway 184 to prevent an individual from attempting to look through the optical viewing pathway 184 through lens 106 and optical viewer 100 to the inside of door 22. When shutter 176 is manually pivoted to the open position by an individual on the inside of door 22, shutter 176 no longer blocks optical viewing pathway 184 such that the individual on the inside of door 22 may visually view through optical viewing pathway 184.

As shown in FIG. 5, bore 154 of shaft 136 of interior message wheel 132 and bore 112 of optical viewer 100, which enable viewing along the optical viewing pathway 184, also provide a substantial hollow cross-sectional area that extends through, and that provides fluid communication through, door 22 between inside surface 24 and outside surface 26 and that substantially reduces the ability of door 22 to prevent the spread of smoke and fire from a first side of door 22 to a second side of door 22. Shaft 136 of interior message wheel 132 may be formed from and made of a material comprising an intumescent material. An intumescent material is a material that expands or swells as a result of being heated above a predetermined temperature, resulting in increased volume of the intumescent material. The intumescent material may comprise a thermoplastic carrier combined with an intumescent activator. Shaft 136 formed of an intumescent material, when at ambient temperatures, retains its original molded configuration. However, when shaft 136 is heated to a predetermined temperature of approximately 200° C. or more, the intumescent material comprising shaft 136 begins to expand or swell from two times to sixty times its original volume or more. Intumescent material may be obtained from Pyrophobic Systems Ltd. of Barrie, Canada.

Figure 6:
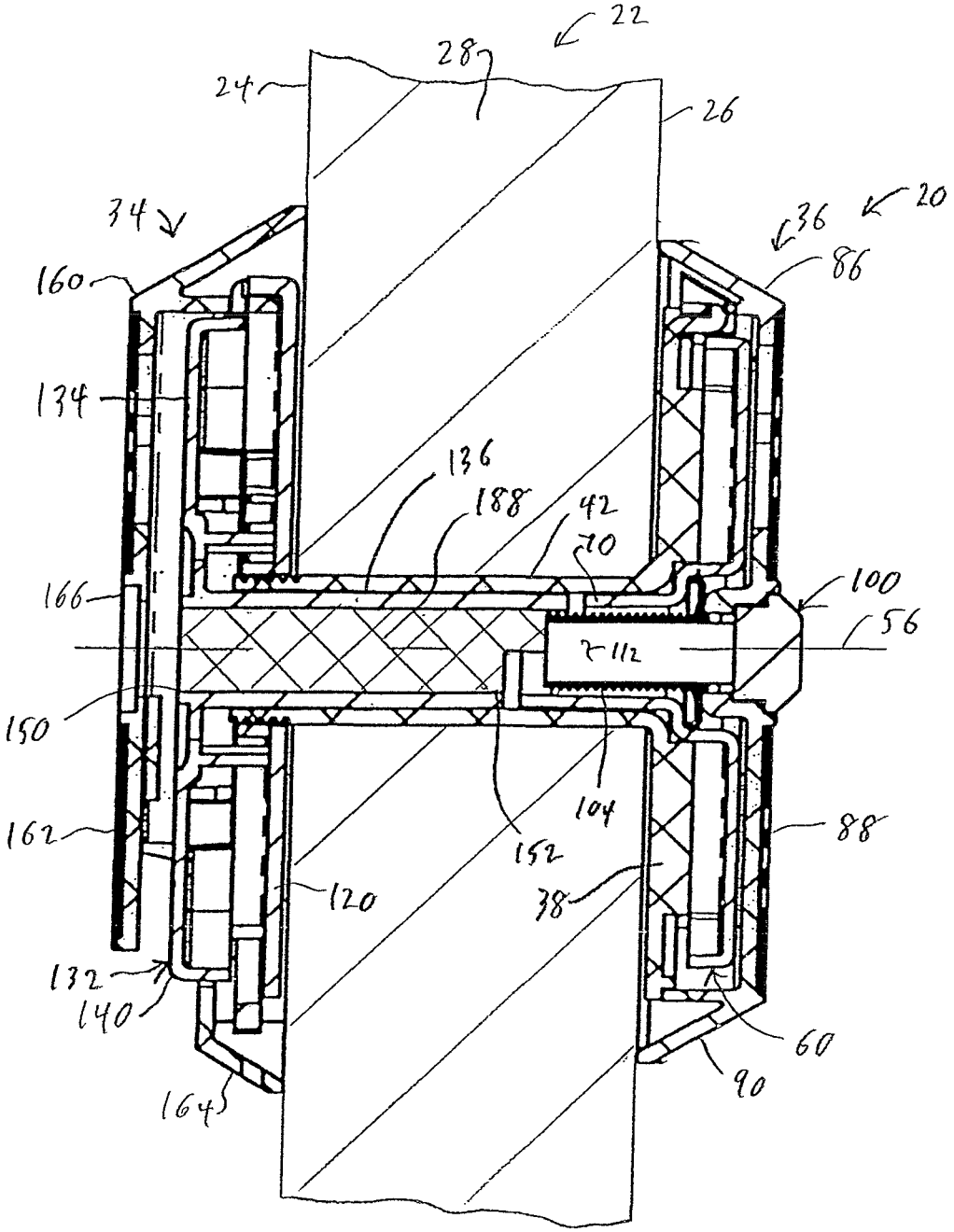
FIG. 6 is a cross sectional view of the door communication device shown coupled to the door similar to FIG. 5, but showing the bore of a shaft of the door communication device blocked by the expansion of the intumescent material from which the shaft is formed after exposure to heat of a predetermined temperature such that the optical viewing pathway through the bore is blocked.
Figure 7:
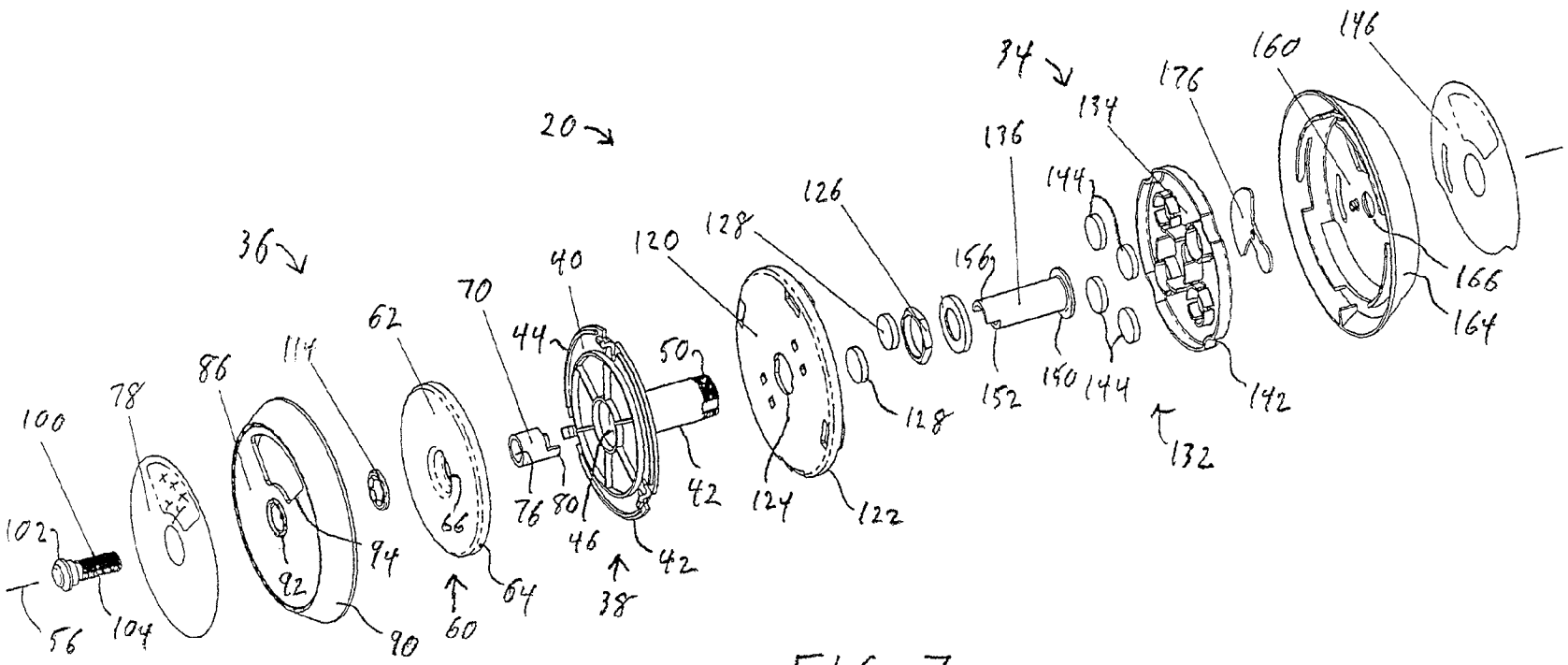
FIG. 7 is an exploded view of the door communication device.
Figure 8:
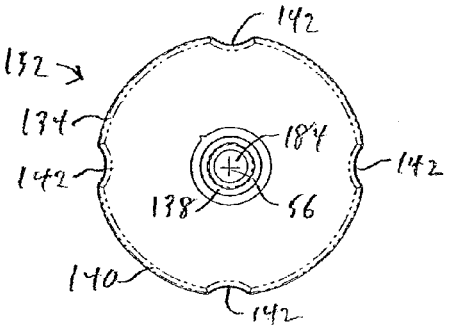
FIG. 8 is a front elevational view of the interior message wheel of the interior unit of the door communication device.
Figure 9:
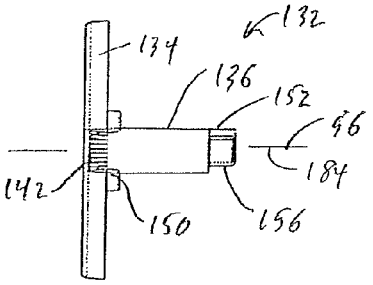
FIG. 9 is a side elevational view of the interior message wheel.
Figure 10:
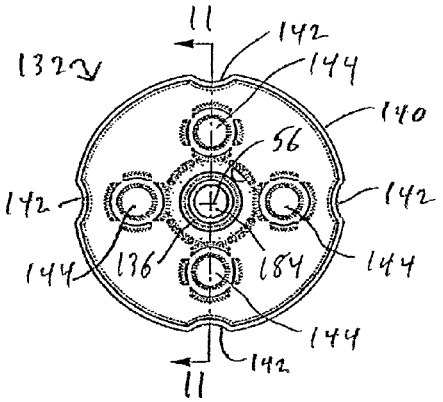
FIG. 10 is a rear elevational view of the interior message wheel.
Figure 11:
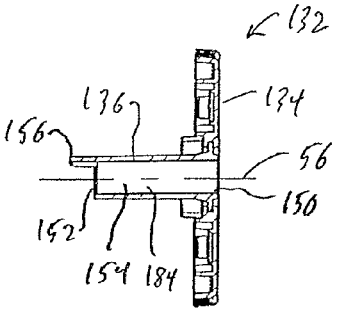
FIG. 11 is a cross sectional view of the interior message wheel taken along line 11-11 of FIG. 10.

FIG. 6 schematically illustrates shaft 136 of interior message wheel 132 after it has been exposed to heat such as from the fire, such that shaft 136 has been heated above the selected predetermined temperature at which the intumescent material begins to expand. The intumescent material that forms shaft 136 expands such that previously hollow bore 154 within shaft 136 is filled with a blockage 188 indicated by the cross hatching in FIG. 6. Blockage 188 seals bore 154 fluid tight from first end 150 to second end 152 of shaft 136. The original tubular form of shaft 136 is thereby converted to a solid shaft. Blockage 188 seals first end 150 fluid tight from second end 152. Blockage 188 formed by the expanded intumescent material of shaft 136 inhibits or prevents the flow of heated gas and smoke through shaft 136 to thereby increase the overall fire rating of door 20 from the fire rating that would otherwise be provided to the door if the bore 154 remained hollow. The intumescent material of shaft 136 also expands after being sufficiently heated to fill any open spaces between shaft 136 and coupler member 42. Blockage 188 also blocks viewing through optical viewing pathway 184. In addition to, or alternatively, shaft 70 of exterior message wheel 60 may be made from an intumescent material, and coupler member 42 may be made from an intumescent material. Door communication device 20, wherein shaft 136 is formed from an intumescent material, is adapted to maintain the fire rating of door 22 to at least a twenty-minute fire rating.

Various features have been particularly shown and described in connection with the illustrated embodiment of the invention, however, it must be understood that these particular arrangements merely illustrate, and that the invention is to be given its fullest interpretation within the terms of the appended claims.

What is claimed is:

1. A door communication device for use with a door having an inside surface and an outside surface, the door communication device comprising:

an interior unit adapted to be located adjacent the inside surface of the door, the interior unit having a first viewing aperture;

an exterior unit adapted to be located adjacent the exterior surface of the door, the exterior unit having a second viewing aperture adapted to be in optical communication with the first viewing aperture of the interior unit along an optical viewing pathway between the first viewing aperture and the second viewing aperture; and a first shaft having a first end, a second end and a hollow bore extending from the first end to the second end of the first shaft, the first shaft adapted to be at least partially located within the door such that the optical viewing pathway between the first viewing aperture and the second viewing aperture extends through the bore of the first shaft, the first shaft comprising an intumescent material;

whereby when the first shaft is heated above a predetermined temperature the intumescent material of the first shaft expands to block the bore of the first shaft and thereby seal the first end of the first shaft from the second end of the first shaft, and wherein the interior unit includes a rotatable interior message wheel having an interior message plate, the first end of the first shaft being coupled to the interior message plate, the first shaft and the interior message plate being selectively rotatable about a central axis.

2. The door communication device of claim 1 wherein the interior unit includes an interior cover including the first viewing aperture, and the exterior unit includes an exterior cover including the second viewing aperture.

3. The door communication device of claim 2 wherein the exterior unit includes an optical viewer coupled to the exterior cover, the optical viewer including the second viewing aperture and a second shaft having a bore through which the optical viewing pathway extends, the second shaft being generally coaxially aligned with the first shaft along a central axis.

4. The door communication device of claim 3 wherein the exterior unit includes a rotatable exterior message wheel having a message plate and a third shaft having a bore, the message plate adapted to include one or more messages, the second shaft of the optical viewer extending into the bore of the third shaft of the exterior message wheel such that the exterior message wheel is rotatable about the central axis with respect to the second shaft of the optical viewer.

5. The door communication device of claim 4 wherein the third shaft of the exterior message wheel comprises an intumescent material.

6. The door communication device of claim 4 wherein the interior unit includes a rotatable interior message wheel adapted to include one or more messages, the first end of the first shaft being coupled to the interior message wheel such that the first shaft and the interior message wheel are conjointly rotatable about the central axis, the optical viewing pathway extending through the interior message wheel.

7. The door communication device of claim 6 wherein the second end of the first shaft is adapted to be coupled to the third shaft of the exterior message wheel such that the interior message wheel and the exterior message wheel are conjointly rotatable about the central axis.

8. The door communication device of claim 4 including an interior plate adapted to be located adjacent the interior surface of the door, an exterior plate adapted to be located adjacent the exterior surface of the door, and a coupler having a first end, a second end and a hollow bore, the coupler adapted to extend within the door and couple the interior plate to the exterior plate, the first shaft and the third shaft of the exterior message wheel adapted to be located within the bore of the coupler and to be rotatable with respect to the coupler.

9. The door communication device of claim 8 wherein the coupler comprises an intumescent material.

10. The door communication device of claim 6 wherein the interior cover includes a window through which a selected message of the one or more messages of the interior message wheel may be viewed by selective rotation of the interior message wheel, and the exterior cover includes a window through which a message of the one or more messages of the exterior message wheel may be viewed by selective rotation of the interior message wheel.

11. The door communication device of claim 10 wherein the interior plate includes one or more first indexing members and the interior message wheel includes one or more second indexing members, the first and second indexing members adapted to cooperate with one another to rotationally index the interior message wheel with respect to the interior plate for displaying a selected message of the interior message wheel through the window of the interior cover.

12. A door communication device for use with a door having an inside surface and an outside surface, the door communication device comprising:

an interior plate adapted to be located adjacent the inside surface of the door;

an exterior plate adapted to be located adjacent the outside surface of the door;

a coupler adapted to extend within the door and couple the interior plate to the exterior plate, the coupler having a first end, a second end, and a hollow bore extending along a central axis of the coupler;

an interior message wheel adapted to be rotated with respect to the door, the interior message wheel including an interior message plate including one or more messages, and a first shaft having a first end attached to the interior message plate, a second end, and a bore extending from the first end to the second end of the first shaft along the central axis, the first shaft adapted to extend through the interior plate and into the bore of the coupler, the first shaft being rotatable with respect to the coupler;

an exterior message wheel adapted to be rotated with respect to the door about the central axis, the exterior message wheel including an exterior message plate including one or more messages, the second end of the first shaft adapted to be coupled to the exterior message wheel such that the exterior message wheel is conjointly rotatable with the interior message wheel;

whereby an optical viewing pathway extends through the bore of the first shaft, and a selected one of the one or more messages on the interior message wheel and on the exterior message wheel can be displayed for viewing by selective rotation of the interior message wheel about the central axis; and, wherein the first shaft of the interior message wheel comprises an intumescent material, such that when the first shaft is heated above a selected temperature the intumescent material expands to block the bore of the first shaft.

13. The door communication device of claim 12 wherein the exterior message wheel includes a second shaft having a first end attached to the exterior message plate, a second end, and a bore extending from the first end to the second end of the second shaft, the second shaft adapted to extend through the exterior plate and into the bore of the coupler, the second shaft being rotatable with respect to the coupler, the second shaft of the exterior message wheel comprising an intumescent material, such that when the second shaft is heated above a selected temperature the intumescent material expands to block the bore of the second shaft.

14. The door communication device of claim 13 including an optical viewer having a head and a third shaft, the head including an optical lens in the optical viewing pathway, the third shaft extending from the head to a distal end, the third shaft extending into the bore of the second shaft of the outer message wheel, the second shaft being rotatable about the central axis with respect to the third shaft of the optical viewer.

15. The door communication device of claim 12 including an interior cover having a window through which a selected one of the one or more messages of the interior message wheel can be viewed, and an exterior cover having a window through which a corresponding message of the one or more messages of the exterior message wheel can be viewed.

16. The door communication device of claim 15 wherein the interior cover includes a slot providing access to the interior message wheel such that the interior message wheel can be manually rotated about the central axis to position a selected message for viewing through the window of the exterior cover.

17. The door communication device of claim 15 including a shutter that is selectively pivotal between a closed position and an open position, the shutter preventing optical viewing through the optical viewing path when in the closed position.

18. The door communication device of claim 12 wherein the interior plate includes one or more first indexing members and the interior message wheel includes one or more second indexing members, the first and second indexing members adapted to rotationally index the interior message wheel between selected rotational positions.

19. A door communication device for use with a door having an inside surface and an outside surface, the door communication device comprising:

an interior plate adapted to be located adjacent the inside surface of the door;

an exterior plate adapted to be located adjacent the outside surface of the door;

a coupler adapted to extend within the door and couple the interior plate to the exterior plate, the coupler having a first end, a second end, and a hollow bore extending along a central axis of the coupler;

an interior message wheel adapted to be rotated with respect to the door, the interior message wheel including an interior message plate including one or more messages, and a first shaft having a first end attached to the interior message plate, a second end, and a bore extending from the first end to the second end of the first shaft along the central axis, the first shaft adapted to extend through the interior plate and into the bore of the coupler, the first shaft being rotatable with respect to the coupler;

an exterior message wheel adapted to be rotated with respect to the door about the central axis, the exterior message wheel including an exterior message plate including one or more messages, the second end of the first shaft adapted to be coupled to the exterior message wheel such that the exterior message wheel is conjointly rotatable with the interior message wheel;

whereby an optical viewing pathway extends through the bore of the first shaft, and a selected one of the one or more messages on the interior message wheel and on the exterior message wheel can be displayed for viewing by selective rotation of the interior message wheel about the central axis; and wherein the exterior message wheel includes a second shaft having a first end attached to the exterior message plate, a second end, and a bore extending from the first end to the second end of the second shaft, the second shaft adapted to extend through the exterior plate and into the bore of the coupler, the second shaft being rotatable with respect to the coupler, the second shaft of the exterior message wheel comprising an intumescent material, such that when the second shaft is heated above a selected temperature the intumescent material expands to block the bore of the second shaft.

20. The door communication device of claim 19 wherein the first shaft of the interior message wheel comprises an intumescent material, such that when the first shaft is heated above a selected temperature the intumescent material expands to block the bore of the first shaft.

21. The door communication device of claim 19 including an optical viewer having a head and a third shaft, the head including an optical lens in the optical viewing pathway, the third shaft extending from the head to a distal end, the third shaft extending into the bore of the second shaft of the outer message wheel, the second shaft being rotatable about the central axis with respect to the third shaft of the optical viewer.

22. The door communication device of claim 19 including an interior cover having a window through which a selected one of the one or more messages of the interior message wheel can be viewed, and an exterior cover having a window through which a corresponding message of the one or more messages of the exterior message wheel can be viewed.

23. The door communication device of claim 22 wherein the interior cover includes a slot providing access to the interior message wheel such that the interior message wheel can be manually rotated about the central axis to position a selected message for viewing through the window of the exterior cover.

24. The door communication device of claim 22 including a shutter that is selectively pivotal between a closed position and an open position, the shutter preventing optical viewing through the optical viewing path when in the closed position.

25. The door communication device of claim 19 wherein the interior plate includes one or more first indexing members and the interior message wheel includes one or more second indexing members, the first and second indexing members adapted to rotationally index the interior message wheel between selected rotational positions.

* * * * *